US008870988B2

(12) United States Patent
Oh et al.

(10) Patent No.: US 8,870,988 B2
(45) Date of Patent: Oct. 28, 2014

(54) DUST COLLECTOR FOR A VACUUM CLEANER HAVING A DUST REMOVAL FUNCTION

(75) Inventors: Jang Keun Oh, Gwangju (KR); Il Du Jung, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 291 days.

(21) Appl. No.: 13/386,305

(22) PCT Filed: Apr. 7, 2010

(86) PCT No.: PCT/KR2010/002114

§ 371 (c)(1),
(2), (4) Date: Jan. 20, 2012

(87) PCT Pub. No.: WO2011/010786

PCT Pub. Date: Jan. 27, 2011

(65) Prior Publication Data

US 2012/0117927 A1 May 17, 2012

(30) Foreign Application Priority Data

Jul. 24, 2009 (KR) ..... 10-2009-0067669
Jul. 29, 2009 (KR) ..... 10-2009-0069281

(51) Int. Cl.

| | |
|---|---|
| ***A47L 9/10*** | (2006.01) |
| ***A47L 9/20*** | (2006.01) |
| ***A47L 9/16*** | (2006.01) |
| ***A47L 9/12*** | (2006.01) |

(52) U.S. Cl.

CPC . *A47L 9/122* (2013.01); *A47L 9/20* (2013.01); *A47L 9/1666* (2013.01)

USPC ..... 55/296; 55/295; 55/304; 55/337; 55/405; 55/429; 15/352; 15/353

(58) Field of Classification Search

CPC ..... B01D 45/12; B01D 46/75; A47L 9/16; A47L 9/81; A47L 9/1608; A47L 9/1666

USPC ..... 55/295–299, 304, 337, 1, 405, 429, 55/459.1, DIG. 3; 15/352–353

See application file for complete search history.

(56) References Cited

U.S. PATENT DOCUMENTS 6,916,351 B2 7/2005 Oh
6,928,692 B2 8/2005 Oh et al.

(Continued)

FOREIGN PATENT DOCUMENTS

JP 2008154800 * 7/2012
KR 2003-0088534 11/2003

(Continued)

OTHER PUBLICATIONS

International Search Report for PCT/KR2010/002114 mailed Nov. 22, 2010.

*Primary Examiner* — Jason M Greene
*Assistant Examiner* — Karla Hawkins
(74) *Attorney, Agent, or Firm* — Staas & Halsey LLP

(57) ABSTRACT

A dust collector includes a dust container; a centrifugal separator installed inside the dust container to separate dust from air; a filter unit installed at a discharge hole of the centrifugal separator and provided with a filter member; and a dust-removing device for dislodging dust from the filter unit. The dust-removing device includes a dust removal unit including a dust-removing member having dust-removing projections formed on an undersurface thereof, wherein the dust-removing projections move back and forth while contacting the filter unit to dislodge dust from the filter unit; and a drive unit for providing driving power to the dust removal unit.

11 Claims, 7 Drawing Sheets

(56) References Cited

U.S. PATENT DOCUMENTS

| | | | | |
|---|---|---|---|---|
| 7,152,277 | B2 | 12/2006 | Jung et al. | |
| 2003/0208879 | A1 * | 11/2003 | Oh et al. | 15/352 |
| 2003/0221278 | A1 | 12/2003 | Oh | |
| 2004/0177471 | A1 | 9/2004 | Jung et al. | |

FOREIGN PATENT DOCUMENTS

| | | |
|---|---|---|
| KR | 10-0437106 | 6/2004 |
| KR | 10-2004-0081706 | 9/2004 |

* cited by examiner

DUST COLLECTOR FOR A VACUUM CLEANER HAVING A DUST REMOVAL FUNCTION

CROSS-REFERENCE TO RELATED APPLICATIONS

This application is a U.S. national phase of International Application No. PCT/KR2010/002114 filed on Apr. 7, 2010, which claims priority to Korean Application No. 10-2009-0067669, filed on Jul. 24, 2009 and Korean Application No. 10-2009-0069281, filed on Jul. 29, 2009, the contents of which are hereby incorporated by reference.

BACKGROUND

1. Field

The present disclosure relates to a dust collector for a vacuum cleaner having a dust removal function which dislodges dust from a filter installed in the dust collector.

2. Description of the Related Art

In order to solve inconvenience of changing a dust bag and burden of expenses, a vacuum cleaner with a centrifugal separator has come into wide use, which is equipped with a dust collector comprising a centrifugal separator which separates dust flowed in by negative pressure from air, a dust container which contains the dust separated by the centrifugal separator, and a filter (a secondary filter) which filters out minute matters included in the air from which the dust is separated.

The conventional dust collector may generally have deteriorated suction force as the secondary filter has fine dust gradually accumulated thereon, and subsequently decreased efficiency of picking up foreign matters from a cleaning surface or separating dust inside the centrifugal separator.

Accordingly, various prior arts are provided for removing the accumulated dust from the secondary filter.

Examples of such prior arts are 'a connection apparatus' of Japanese Laid-Open Patent Publication No. 2008-272112 (hereinafter referred to as "prior art 1") and 'an electric cleaner (a vacuum cleaner)' of Japanese Laid-Open Patent Publication No. 2008-154800 (hereinafter referred to as "prior art 2").

Prior art 1 discloses a configuration that a driven unit moves back and forth along a guide member by a drive unit while projections formed on a driven member impact on a filter so as to dislodge dust accumulated on the filter. Prior art 2 discloses a configuration that an elastic member moves back and forth according to a rotation of gear while impacting on a filter so as to dislodge dust accumulated on the filter.

The above described prior arts are capable of removing dust accumulated on a filter (a secondary filter) installed in a dust collector autonomously while driving a vacuum cleaner. However, prior art 1 presents a problem in that since a driving unit is arranged to overlap with a driven unit, a combination structure is wide, and in case of a dust collector having a vertical structure, this results in increasing a height of the whole dust collector.

Further, said prior arts 1 and 2 present a problem in that as configurations of impacting on a filter using the projections formed on both sides of the driven unit (prior art 1) and the elastic member of grid structure (prior art 2), since a contact area is small between the projections formed on the driven unit or the elastic member for dislodging dust and the filter, vibration is not sent to the entire filter, and thus dust accumulated on the filter is not removed effectively. Another problem lies in that dust is not removed evenly from the entire filter.

SUMMARY

The present disclosure has been developed in order to overcome the above drawbacks and other problems associated with the above described prior arts. An aspect of the present disclosure is to provide a dust collector for a vacuum cleaner having a dust removal function, wherein the total volume of the dust collector does not increase and the efficiency in removing dust collected on a filter is improved.

Further, another aspect of the present disclosure is to provide a dust collector for a vacuum cleaner having a dust removal function which improves the efficiency in removing dust from the entire filter.

Further, another aspect of the present disclosure is to provide a dust collector for a vacuum cleaner having a dust removal function which reduces pressure loss and improves structures.

In one general aspect, there is provided a dust collector for a vacuum cleaner having a dust removal function includes a dust container; a centrifugal separator installed inside the dust container to separate dust from air; a filter unit installed at a discharge hole of the centrifugal separator and provided with a filter member; and a dust-removing device for dislodging dust from the filter unit. The dust-removing device includes a dust removal unit including a dust-removing member having dust-removing projections formed on an undersurface thereof, wherein the dust-removing projections move back and forth while contacting the filter unit to dislodge dust from the filter unit; and a drive unit for providing driving power to the dust removal unit.

The filter unit and the dust removal unit can be installed in a slanted manner.

The dust-removing member can be installed to be separated from one another between a plurality of dust-removing members at regular intervals.

The dust removal unit may further include a first fixing member which fixedly connects ends of the plurality of dust-removing members and a connecting member which fixedly connects other ends of the plurality of dust-removing members.

The filter unit may further include a guide member which guides back-and-forth movements of the dust-removing members.

The drive unit includes a motor provided with a motor shaft, a cam combined with the motor shaft, a first camshaft combined to be eccentric with the cam, a second camshaft installed to be separated from the first camshaft at regular intervals and fixed to the connecting member, and a cam link which connects the first camshaft and the second camshaft.

The drive unit includes a motor provided with a motor shaft, a rotating camshaft connected to the motor shaft, and a rotating cam combined to be eccentric with the rotating camshaft. The rotating cam can be constituted to apply power in the direction perpendicular to the motor shaft to the connecting member.

A contact area of the connecting member and the rotating cam can be constituted as convex curved surface.

The rotating cam can be constituted to further include an elastic member which applies power to the dust removal unit in the direction opposite to the power applied to the connecting member.

The inside of the dust container can be constituted to be divided into the centrifugal separator, a dust collecting area in which stores dust separated in the centrifugal separator, and a filter dust collecting space in which stores dust separated from the filter unit.

The filter dust collecting space, the centrifugal separator, and the dust collecting area can be arranged in a row along a transverse direction.

According to the aspects of the present disclosure, there is an advantage in that the dust collector providing the function of dislodging dust is minimized not to increase in size by arranging the dust removal unit and the drive unit on the same plane.

Also, there is an advantage in that the dust removal unit and the drive unit are arranged not to overlap with each other on the same plane and this leads to facilitating assembly and management of the dust removal unit and the drive unit, and accordingly facilitating assembly and management of the dust collector.

Also, there is an advantage in that the contact area of the dust removal unit and the filter member increases and impact is sent to the entire filter so that dust accumulated on the whole area of the filter can be removed evenly.

BRIEF DESCRIPTION OF THE DRAWINGS

These and/or other aspects and advantages will become apparent and more readily appreciated from the following description of the embodiments, taken in conjunction with the accompanying drawings of which:

FIG. 6 illustrates a state that a dust removal unit 350 moves in the direction opposite to a motor 311 and FIG. 7 illustrates a state that the dust removal unit 350 moves in the direction of the motor 311.

DETAILED DESCRIPTION

Hereinafter, exemplary embodiments of the present disclosure will be described in further detail with reference to the accompanying drawings.

Figure 1:
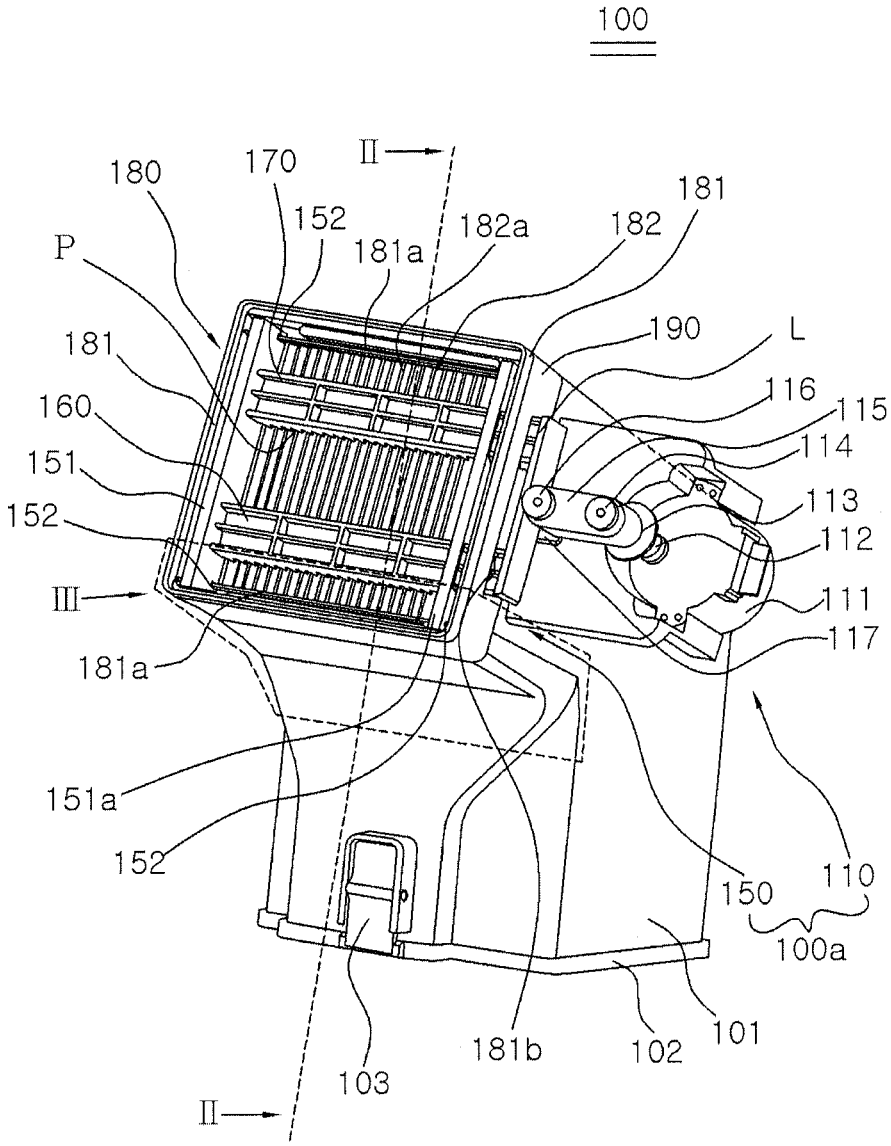
FIG. 1 is a perspective view illustrating a dust collector 100 according to a first exemplary embodiment of the present disclosure.
Figure 2:
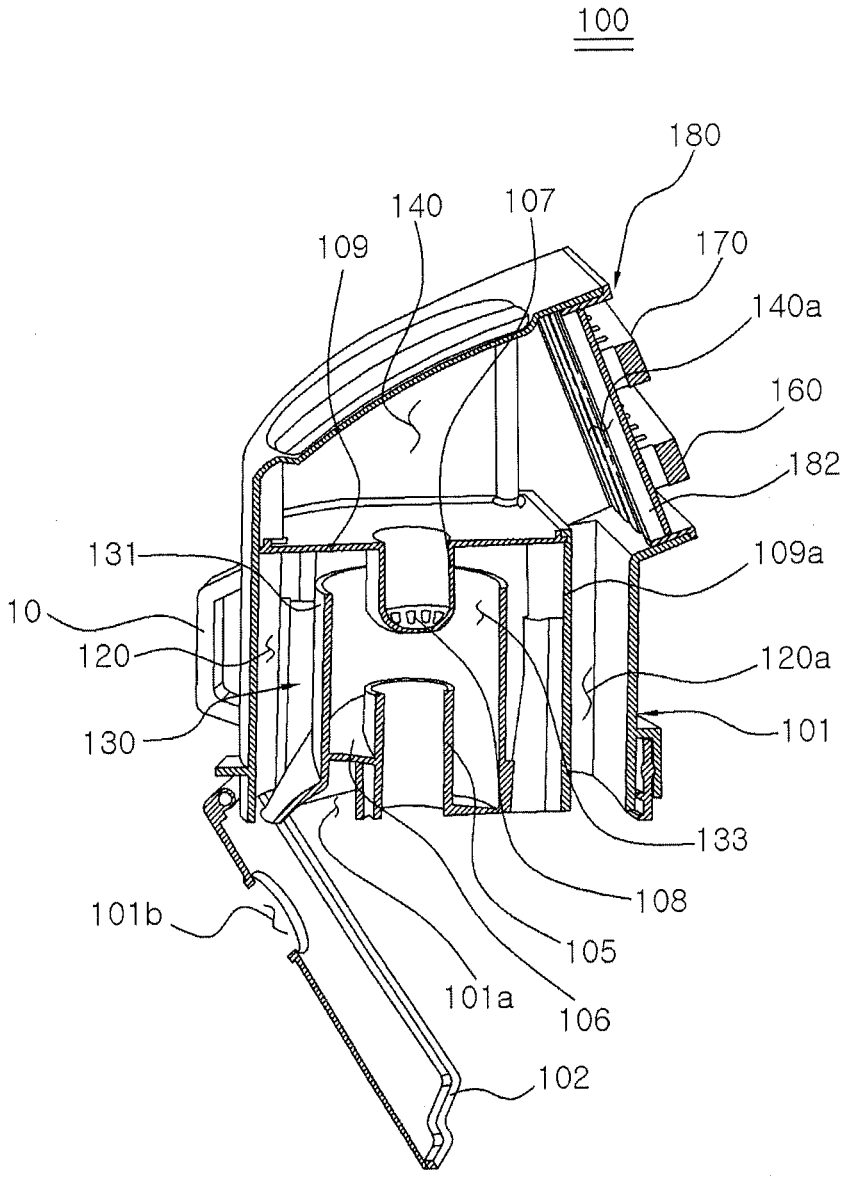
FIG. 2 is a partial section view illustrating a dust collector 100 cut along line II-II shown in FIG. 1.
Figure 3:
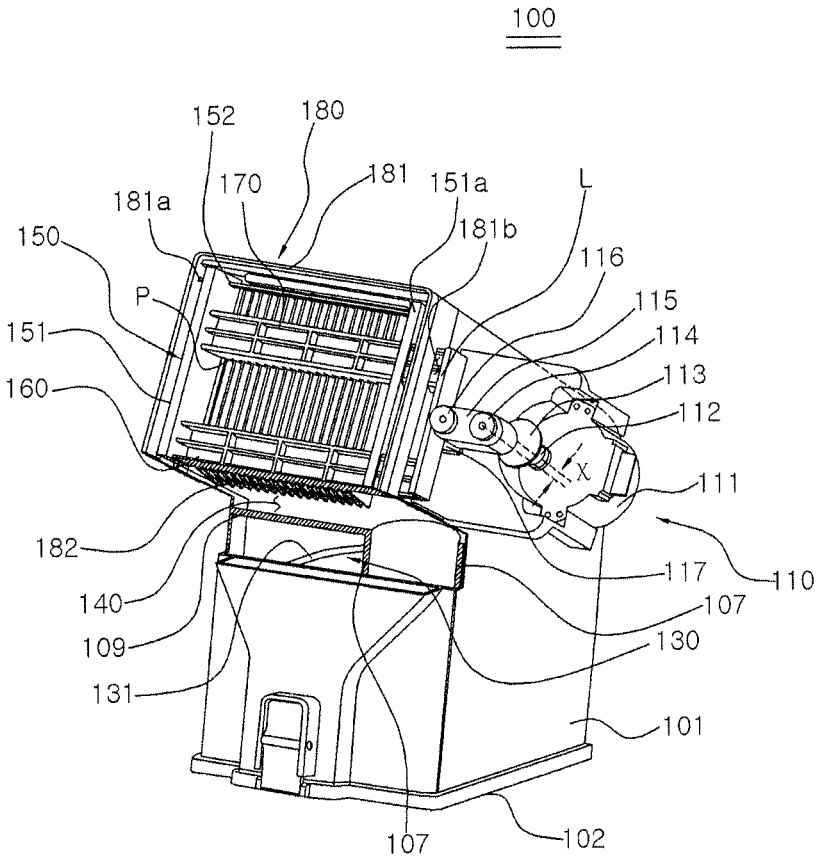
FIGS. 3 and 4 are partially exploded perspective views illustrating a dust collector 100 cut portion III shown in FIG. 1 so as to show a back and forth movement of a first dust-removing member 160 and a second dust-removing member 170.
Figure 4:
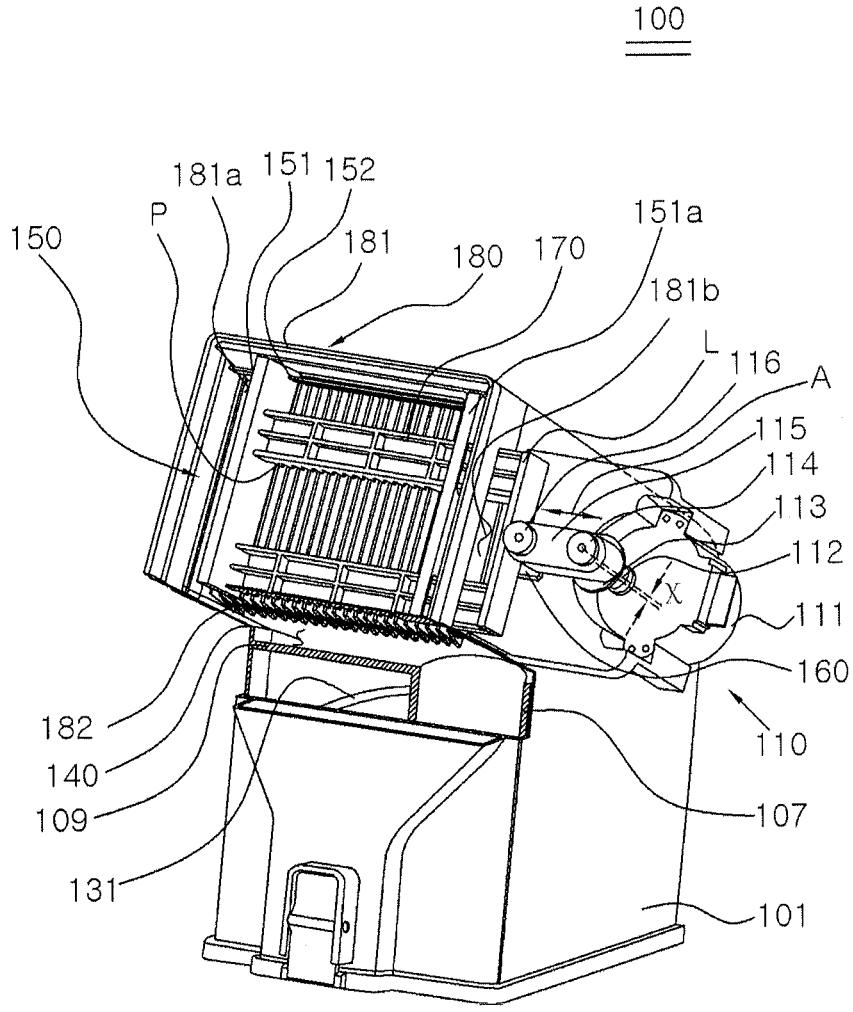

FIG. 1 is a perspective view illustrating a dust collector 100 according to a first exemplary embodiment of the present disclosure, FIG. 2 is a partial section view illustrating a dust collector 100 cut along line II-II shown in FIG. 1, and FIGS. 3 and 4 are partially exploded perspective views illustrating a dust collector 100 cut portion III shown in FIG. 1 so as to show a back and forth movement of a first dust-removing member 160 and a second dust-removing member 170.

Referring to FIGS. 1 to 4, the dust collector 100 according to the first exemplary embodiment of the present disclosure includes a dust container 101, a centrifugal separator 130, a filter unit 180, and a dust-removing device 100*a*.

The dust container 101 is equipped with a handle 10 on the outside thereof, and is divided into a dust collecting area 120 and a centrifugal separator 130 which are installed inside the dust container 101. An upper part of the centrifugal separator 130 is divided from a discharge unit 140 by a first partitioning wall 109. A lower area of the filter unit 180 on side portions of the centrifugal separator 130 forms a filter dust collecting area 120*a* divided from the dust collecting area 120 by a second partitioning wall 109*a*. The discharge unit 140 includes a discharge hole 140*a* which is disposed in an upper part of the filter dust collecting area 120*a*, and leans at a certain angle with respect to the vertical direction. The discharge hole 140*a* also leans at a certain angle with respect to the vertical direction so as to discharge air in a slanting direction at a certain angle. Accordingly, dust dislodged from a filter member 182 falls into the filter dust collecting area 120*a* and is prevented from flowing into a discharge pipe 107. The upper part of the filter dust collecting area 120*a* communicates with the lower area of the filter unit 180 of the discharge unit 140 and the filter dust collecting area 120*a* collects dust dislodged from the filter member 182.

A dust container cover 102 is coupled to an undersurface of the dust container 101, including undersurfaces of the dust collecting area 120 and the filter dust collecting area 120*a*, to be able to open and close, and the dust container cover 102 is used to remove foreign matters such as dust, and the like, collected in the dust collecting area 120 and the filter dust collecting area 120*a*.

A dust container cover inlet 101*b* is formed in the dust container cover 102, which flows outside air including foreign matters of a cleaning surface into the dust collector 100. The dust container cover 102 may discharge simultaneously dust collected in the dust collecting area 120 and the filter dust collecting area 120*a* when the dust container 101 opens. Accordingly, a user can empty out simultaneously the dust collected in the dust collecting area 120 and the filter dust collecting area 120*a*.

The centrifugal separator 130 includes a centrifugal separating tube 131 installed vertically, a stabilizer 105, an air current guide 106, and a discharge pipe 107.

The centrifugal separating tube 131 divides a centrifugal separating area 133 from the dust collecting area 120 which collects dust separated from the centrifugal separator 130. An upper part of the centrifugal separating tube 131 is installed in a vertically upward direction in the inner and undersurface of the dust container 101, and the upper part of the centrifugal separating tube 131 is at the height of being separated from an undersurface of the first partitioning wall 109 at regular intervals. The dust separated from the centrifugal separator 130 is discharged into the dust collecting area 120 through the space provided between the undersurface of the first partitioning wall 109 and the upper part of the centrifugal separating tube 131.

The stabilizer 105 is installed in a vertically upward direction in the inner and undersurface of the centrifugal separating tube 131 so as to induce air flowed into the centrifugal separating tube 131 to rotate and move upwardly.

The air current guide 106 is installed between the stabilizer 105 and the centrifugal separating tube 131, the lower part of the air current guide 106 forms an inlet 101*a* communicating with the dust container cover inlet 101*b*, and the air current guide 106 is extendedly formed in a spirally upward direction on the basis of the stabilizer 105. The air current guide 106 having such a structure draws outside air flowed in through the inlet 101*a* to rotate on the stabilizer 105 and move upwardly.

The discharge pipe 107 forms a grill 108 in a lower part thereof and has a pipe structure which is penetrated up and down. The discharge pipe 107 is extendedly installed from the undersurface of the first partitioning wall 109 to the inner of the centrifugal separating tube 131 downwardly so that an upper part thereof communicates with the discharge unit 140.

The centrifugal separator 130 is installed inside the dust container 101 and is divided from the dust collecting area 120. Further, as described above, the lower space of the filter unit 180 is separated as the filter dust collecting area 120*a*. Such a structure makes it possible to reduce the whole height of the dust container 101 and results in miniaturization and compactification of the dust collector 100. Such miniaturization and compactification of the dust collector 100 is achieved more effectively when the centrifugal separator 130 is adjacent to the lower part of the filter member 182.

The centrifugal separator 130 is installed vertically and air flowed in through the inlet 101*a* flows through the discharge pipe 107, the filter unit 180, and the discharge hole 140*a* in an upward direction without a reversal of direction. This leads to reducing pressure loss. Further, the filter dust collecting area 120*a*, the centrifugal separator 130, and the dust collecting area 120 are arranged in a row along a transverse direction and this results in forming the whole height of the dust collector 100 in a compact manner.

The filter unit 180 includes a filter case 190, a filter gasket 181, and a filter member 182. The filter member 182 is encased in the filter case 190 and the filter gasket 181 is installed around the circumference of an end of the filter case 190. The filter gasket 181 plays a role in stopping leak of air when the dust collector 100 is installed in a vacuum cleaner. The filter member 182 is coupled fixedly to the discharge hole 140*a* of the dust container 101. A bent part 182*a* of a peak of the filter member 182 is constituted to withstand frictional impact by a plastic insert injection when being in contact with the first dust-removing member 160 and the second dust-removing member 170. The guide member 181*a* guides back-and-forth movements of the dust removal unit 150, and the first dust-removing member 160 and the second dust-removing member 170 are exposed outside penetrating a dust-removing member moving hole 181*b*. The filter unit 180 is installed to have a certain slope on the upper part of the centrifugal separator 130. Accordingly, filter dust separated from the filter member 182 is minimized flying from the filter dust collecting area 120*a* to the outside, and also the dust can be easily separated from the filter member 182 by easing free fall of the separated dust.

The dust-removing device 100*a* includes the drive unit 110 and the dust removal unit 150. The drive unit 110 is coupled to a side of the upper part of the dust container 101 so as to send driving force for back-and-forth movements to the dust removal unit 150. The dust removal unit 150 is constituted to dislodge dust collected in the filter member 182 by moving back and forth by means of the drive unit 110 on the upper part of the filter member 182.

The drive unit 110 is constituted to include a motor 111 provided with a motor shaft 112, a cam 113 coupled to the motor shaft 112, a first camshaft 114 coupled to be eccentric with the cam 113, a camshaft link 115 wherein the first camshaft 114 is coupled rotatably to an end of the camshaft link 115, and an upper end of a second camshaft 116 coupled rotatably to the other end of the camshaft link 115 and a lower end of the second camshaft 116 coupled rotatably to a connecting member (L).

The dust removal unit 150, as shown in FIG. 1, includes a first dust-removing member 160, a second dust-removing member 170, a first fixing member 151, a second fixing member 151*a*, and a connecting member (L). The first dust-removing member 160 and the second dust-removing member 170 include a plate which can move left and right. A plurality of dust-removing projections (P) is formed to project in the longitudinal direction at regular intervals on undersurfaces of the first dust-removing member 160 and the second dust-removing member 170. The dust-removing projections (P) have peak and valley, and apply impact while the first dust-removing member 160 and the second dust-removing member 170 move back and forth. The first dust-removing member 160 and the second dust-removing member 170 can be two or more.

On side portions of the first fixing member 151 and the second fixing member 151*a*, a guide groove 152, into which the guide member 181*a* is inserted, is formed so that left and right reciprocating motion thereof can be guided along the guide member 181*a*.

The first fixing member 151 fixedly connects adjacent ends of the first dust-removing member 160 and the second dust-removing member 170 which are far from the drive unit 110. The second fixing member 151*a* guides portions of the first dust-removing member 160 and the second dust-removing member 170 which are adjacent to the drive unit 110 and is fixed so that the first dust-removing member 160 and the second dust-removing member 170 move penetrating the second fixing member 151*a*.

The ends adjacent to the drive unit 110 of the first dust-removing member 160 and the second dust-removing member 170 are exposed to be possible to move back and forth to the outside of the filter case 190 through the dust-removing member moving hole 181*b*. The connecting member (L) connects the ends of the first dust-removing member 160 and the second dust-removing member 170 which are exposed to the outside of the filter case 190, and provides an extending unit 117 coupled rotatably to an end of the second camshaft 116 and connects the dust removal unit 150 to the drive unit 110.

Figure 5:
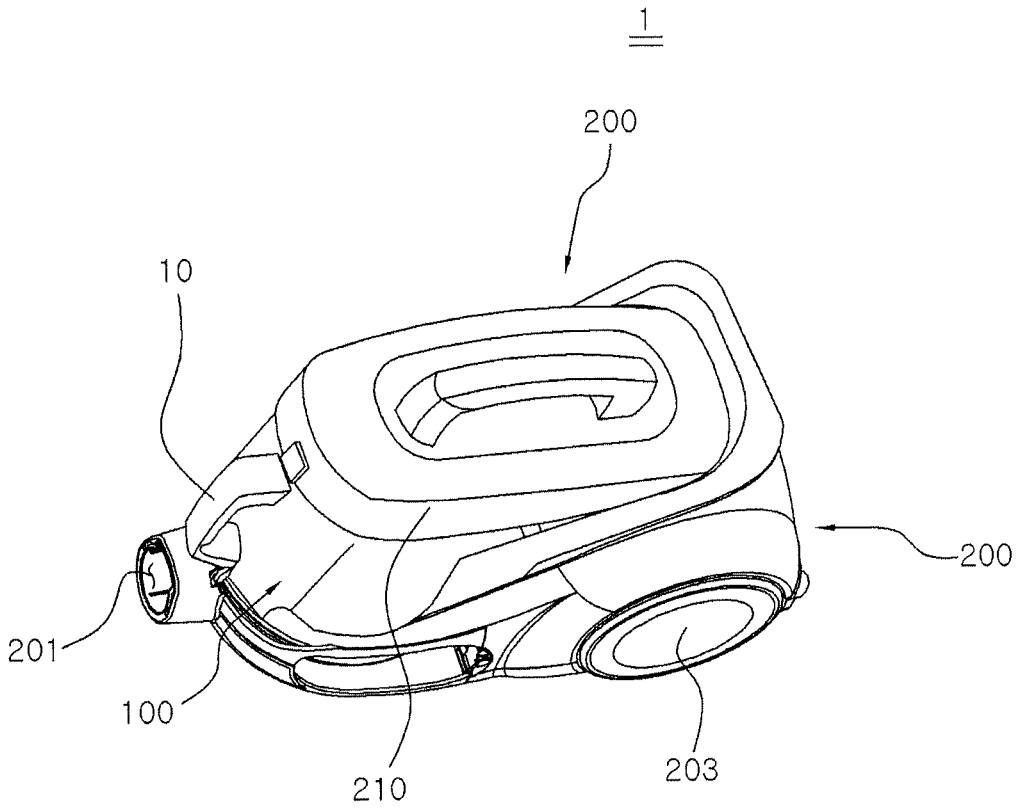
FIG. 5 is a perspective view illustrating a vacuum cleaner 1 equipped with a dust collector 100 shown in FIG. 1.

The dust collector 100 having the structure as shown in FIGS. 1 to 4 according to a first exemplary embodiment of the present disclosure is equipped in a vacuum cleaner 1 so that the discharge hole 140*a* can communicate with an inlet (not shown) of a fan motor unit, and then is adjusted by a main body cover 210 (see FIG. 5).

When the vacuum cleaner 1 drives, the dust collector 100 separates dust from air flowed by suction force occurring in the fan motor unit, collects in the dust collecting area 120, and discharges the air from which the dust is separated, through the discharge hole 140*a*.

The filter member 182 filters out fine dust which is not separated in the centrifugal separator 130. The dust-removing device 100*a* removes dust accumulated on the filter member 182, and thus prevents the filter member 182 from blocking in spite of a continuous use of the vacuum cleaner 1.

Hereafter, referring to FIGS. 1 to 4, an operation of the dust-removing device 100*a* is described.

When the dust-removing device 100*a* drives, the motor shaft 112 rotates and the cam 113 rotates according to the rotation of the motor shaft 112. When the cam 113 rotates, the first camshaft 114 coupled to be eccentric with the cam 113 rotates in a circle with a radius of an eccentric distance (x) from the center of the upper part of the cam 113. The first camshaft 114 rotates having a bond radius, the camshaft link 115 (see arrow A of FIG. 4) make back and forth vibrating movements. Accordingly, the dust removal unit 150 moves left and right within the range of distance corresponding to a rotational diameter of the first camshaft 114 as shown in FIGS. 3 and 4. FIG. 3 illustrates a state that the dust removal unit 150 moves in a direction opposite to the motor 111 and FIG. 4 illustrates a state that the dust removal unit 150 moves in the direction of the motor 111.

In accordance with the left and right movements of the dust removal unit 150, the dust-removing projections (P) formed on undersurfaces of the first dust-removing member 160 and the second dust-removing member 170 impact with the upper part of the filter member 182 to dislodge dust (filter dust) accumulated on the filter member 182. In this case, since the dust-removing projections (P) are formed on the entire undersurfaces of the first dust-removing member 160 and the second dust-removing member 170, they can contact the whole area of the filter member 182. Accordingly, since impact force occurring from the dust-removing projections (P) is sent to the whole area of the filter member 182 and the sent impact force increases in proportion to a contact area, the dust accumulated on the filter member 182 is effectively removed. The dust separated from the filter member 182 is collected in the filter dust collecting area 120*a*.

As described above, the dust collected in the dust collecting area 120 and the filter dust collecting area 120*a* is empty at the same time when the dust container cover 102 opens after the dust collector 100 is separated from the vacuum cleaner 1.

An operation time and period of the dust-removing device 100*a* may be constituted in various manners. In other words, the dust-removing device 100*a* may be constituted to operate automatically during a standby time prior to turning on the vacuum cleaner 1 and another standby time prior to separating a power cord from an outlet after turning off the vacuum cleaner 1. Further, the dust-removing device 100*a* may be constituted to be driven by a user individually by means of a switch (not shown) provided in the vacuum cleaner 1.

FIG. 5 is a perspective view illustrating a vacuum cleaner 1 equipped with the dust collector 100 shown in FIG. 1.

A main body 200 of the vacuum cleaner 1 includes a hose coupling hole 201, a main body cover 210 which fixes a dust collector 100, and wheels 203 to move the vacuum cleaner 1.

The hose coupling hole 201 is disposed in a lower part of the main body 200 and is coupled to a nozzle hose (not shown). An end of one side of the main body cover 210 is coupled to the main body 200 to be able to open and close by hinge.

Figure 6:
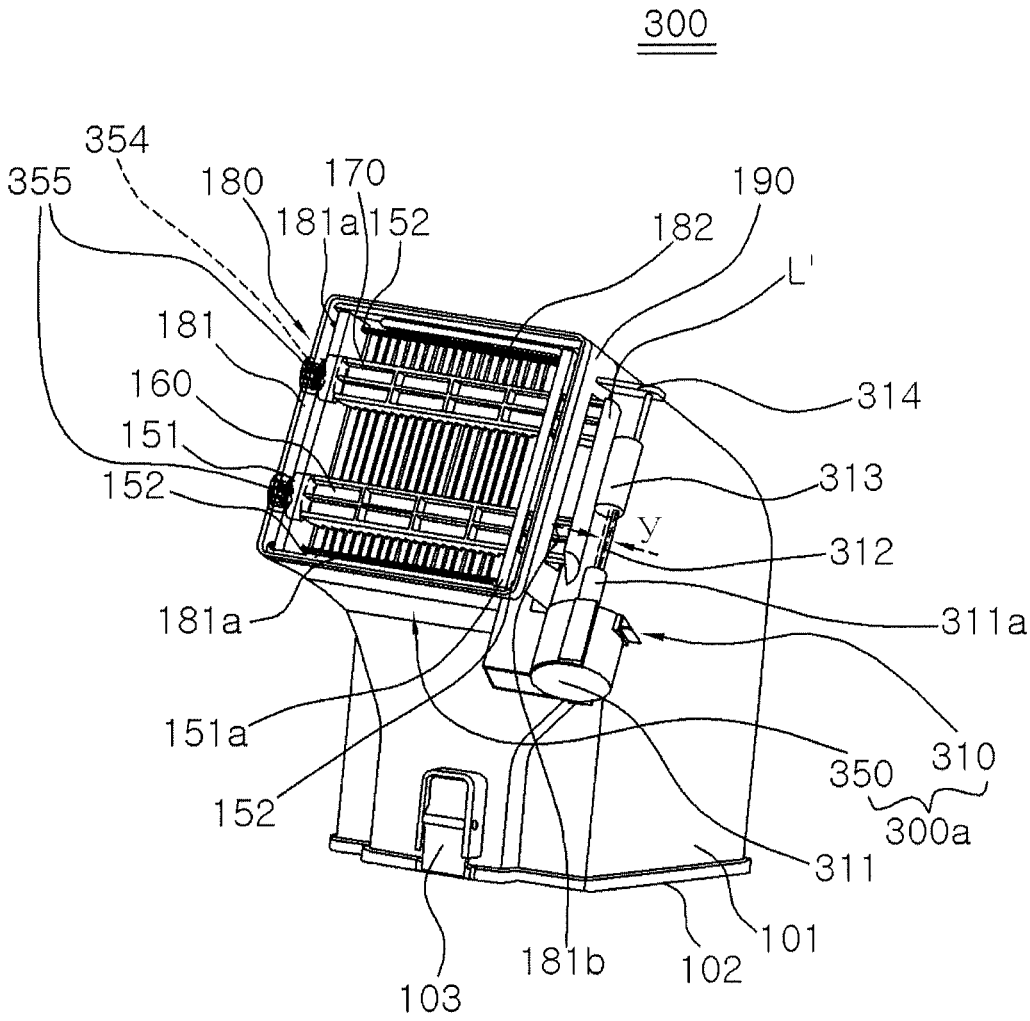
FIGS. 6 and 7 are perspective views illustrating a dust collector 300 according to a second exemplary embodiment of the present disclosure.
Figure 7:
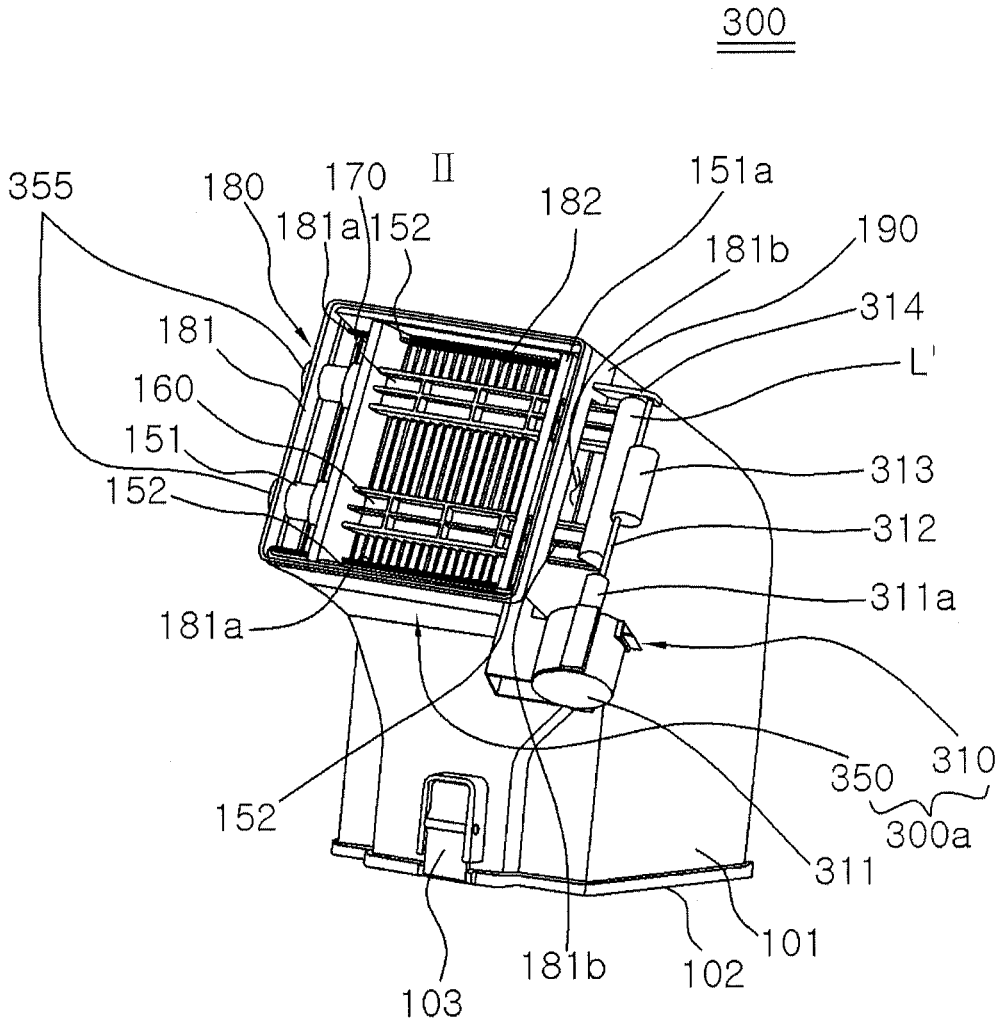

FIGS. 6 and 7 are perspective views illustrating a dust collector 300 according to a second exemplary embodiment of the present disclosure, and FIG. 6 illustrates a state that a dust removal unit 350 moves in the direction opposite to a motor 311 and FIG. 7 illustrates a state that the dust removal unit 350 moves in the direction of the motor 311.

Referring to FIGS. 6 and 7, the dust collector 300 according to the second exemplary embodiment of the present disclosure is different from the dust collector 100 and the dust-removing device 150 according to the first exemplary embodiment of the present disclosure in terms of constitution, but the remaining constitutions thereof are identical to each other. Therefore, among the constitutions of the dust-removing device 350, the only constitutions different from those of the first exemplary embodiment are described, but the constitutions identical to those of the first exemplary embodiment are shown as reference numerals which are the same as the first exemplary embodiment and their explanations are omitted.

The dust-removing device 300*a* according to the second exemplary embodiment of the present disclosure, as shown in FIG. 6, includes a drive unit 310 and a dust removal unit 350. The drive unit 310 includes a motor 311, a rotating camshaft 312, a rotating cam 313, and a support member 314.

The motor 311 provides with a motor shaft 311*a*. An end of the rotating camshaft 312 makes an axial combination with the motor shaft 311*a*.

The rotating cam 313 is insertedly coupled to be eccentric with the rotating camshaft 312 in a cylindrical shape. The support member 314 is formed projecting on the outside of the dust collector 300 and supports an end of the rotating camshaft 312 rotatably.

The dust removal unit 350 includes an elastic member 355, a first dust-removing member 160, a second dust-removing member 170, a first fixing member 151, a second fixing member 151*a*, and a connecting member (L').

The first dust-removing member 160, the second dust-removing member 170, the first fixing member 151, and the second fixing member 151*a* are constitutions which are identical to those of the first exemplary embodiment of the present disclosure, and thus their explanations are omitted.

The elastic member 355, as shown in FIG. 6, applies pressure to ends of the first dust-removing member 160 and the second dust-removing member 170 in a direction of a motor, that is, the dust removal unit 350 elastically in a direction opposite to force applied to the connecting member (L'), as a coil spring installed inside an elastic member case 354 installed penetrating a filter case 190.

The connecting member (L') fixedly connects adjacent ends of the first dust-removing member 160 and the second dust-removing member 170 which are exposed to the side of the drive unit 310. The connecting member (L') is a semicircular column, whose cross section is a semicircle shape and a surface contacting the rotating cam 313 is convex curved surface. Among the cross sections of the semicircle shape of the connecting member (L'), a flat surface side is coupled to ends of the first dust-removing member 160 and the second dust-removing member 170 and a semi-circular side contacts the rotating cam 313.

Referring to FIGS. 6 and 7, there is provided explanations of an operation of the dust-removing device 100*a* according to the second exemplary embodiment of the present disclosure.

When the dust-removing device 100*a* drives, the motor 311 drives and the motor shaft 311*a* rotates and the rotating camshaft 312 rotates according to the rotation of the motor shaft 311*a*. When the rotating camshaft 312 rotates, the rotating cam 313 rotates in a circle with a radius of a distance (y) between the center of the rotating cam 313 and the axial center of the rotating camshaft 312 on the basis of the rotating camshaft 312. When the rotating cam 313 rotates and appears in a position as shown in FIG. 6, it applies force to the connecting member (L') in the direction opposite to the motor 311 and in the direction perpendicular to the motor shaft 311*a*. When the rotating cam 313 appears in a position as shown in FIG. 7, the connecting member (L') moves in the direction of the motor 311 and goes back to the original position by the elastic member 355, and moves left and right in a state of bonding to the rotating cam 313.

If the connecting member (L') moves back and forth according to the rotation of the rotating cam 313, the first dust-removing member 160 and the second dust-removing member 170 move back and forth in a state of contacting the upper part of the filter member 182.

If the first dust-removing member 160 and the second dust-removing member 170 move back and forth, dust-removing projections (P) formed on undersurfaces of the first dust-removing member 160 and the second dust-removing member 170 impact with the upper part of the filter member 182 to dislodge dust (filter dust) accumulated on the filter member 182. Accordingly, since impact force occurring from the dust-removing projections (P) is sent to the whole area of the filter member 182 and the sent impact force increases in proportion to a contact area, the dust accumulated on the filter member 182 is effectively removed. The dust separated from the filter member 182 is collected in the filter dust collecting area 120*a*. The dust collected in the dust collecting area 120 and the filter dust collecting area 120*a* is empty at the same time when the dust container cover 102 opens after the dust collector 300 is separated from the vacuum cleaner 1.

The dust collector 100, 300 according to the present disclosure is described and illustrated as the stabilizer 105 formed vertically and the vertical centrifugal separator 130 which provides the discharge pipe 107, but the centrifugal separator 130 may be formed in a lying shape.

Further, the centrifugal separator 130 can be formed in a plural manner.

Further, the centrifugal separator 130 includes a main centrifugal separator which separates big and heavy dust and a plurality of auxiliary centrifugal separators (not shown) which removes fine dust included in air from which the dust is separated by the main centrifugal separator.

The present disclosure is applicable to cleaning apparatuses for use in home, business, and industrial cleaners.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A dust collector for a vacuum cleaner comprising:

a dust container;

a centrifugal separator installed inside the dust container to separate dust from air, the centrifugal separator including a centrifugal separating tube installed vertically, a stabilizer, an air current guide, and a discharge pipe having a grill formed in a lower part thereof;

a discharge unit formed installed inside the container, the discharge unit including a discharge hole connected to the discharge pipe;

a filter unit installed at the discharge hole, the filter unit being provided with a filter member; and a dust-removing device to dislodge dust from the filter unit, wherein the dust-removing device comprises a dust removal unit including a dust-removing member having dust-removing projections formed on an undersurface thereof, wherein the dust-removing projections move back and forth while contacting the filter unit to dislodge dust from the filter unit; and a drive unit to provide driving power to the dust removal unit.

2. The dust collector for a vacuum cleaner as claimed in claim 1, wherein the filter unit and the dust removal unit are installed slantedly.

3. The dust collector for a vacuum cleaner as claimed in claim 1, wherein the dust-removing member comprises a plurality of dust-removing members which are installed to be separated from one another at regular intervals.

4. The dust collector for a vacuum cleaner as claimed in claim 3, wherein the dust removal unit further comprises:

a fixing member fixedly connecting ends of the plurality of dust-removing members; and a connecting member fixedly connecting other ends of the dust-removing members.

5. The dust collector for a vacuum cleaner as claimed in claim 4, wherein the filter unit further comprises a guide member guiding back and forth movements of the dust-removing members.

6. The dust collector for a vacuum cleaner as claimed in claim 4, wherein the drive unit comprises:

a motor provided with a motor shaft;

a cam coupled to the motor shaft;

a first camshaft coupled to be eccentric with the cam;

a second camshaft installed to be separated from the first camshaft at regular intervals and fixed into the connecting member; and a cam link connecting the first camshaft and the second camshaft.

7. The dust collector for a vacuum cleaner as claimed in claim 4, wherein the drive unit comprises:

a motor provided with a motor shaft;

a rotating camshaft coupled to the motor shaft; and a rotating cam coupled to be eccentric with the rotating camshaft;

wherein the rotating cam applying force to the connecting member in a direction perpendicular to the motor shaft.

8. The dust collector for a vacuum cleaner as claimed in claim 7, wherein a surface of the connecting member which contacts the rotating cam is a convex curved surface.

9. The dust collector for a vacuum cleaner as claimed in claim 7, wherein the drive unit further comprises an elastic member applying pressure to the dust removal unit in a direction opposite to force applied to the connecting member by the rotating cam.

10. The dust collector for a vacuum cleaner as claimed in claim 1, wherein the inside of the dust container is divided into the centrifugal separator, a dust collecting area storing dust separated from the centrifugal separator, and a filter dust collecting area storing dust separated from the filter unit.

11. The dust collector for a vacuum cleaner as claimed in claim 10, wherein the filter dust collecting area, the centrifugal separator, and the dust collecting area are arranged in a row along a transverse direction.

* * * * *